United States Patent [19]

Landaeus

[11] 4,350,214

[45] Sep. 21, 1982

[54] RAM BLOCK

[75] Inventor: Kjell G. Landaeus, Lund, Sweden

[73] Assignee: Lund Hydromaskin AB, Eslöv, Sweden

[21] Appl. No.: 193,527

[22] PCT Filed: Sep. 4, 1979

[86] PCT No.: PCT/SE79/00178

§ 371 Date: May 5, 1980

§ 102(e) Date: May 5, 1980

[87] PCT Pub. No.: WO80/00584

PCT Pub. Date: Apr. 3, 1980

[30] Foreign Application Priority Data

Sep. 5, 1978 [SE] Sweden ..... 7809303

[51] Int. Cl.[3] ..... B25D 17/06

[52] U.S. Cl. ..... 173/126; 173/DIG. 2; 227/156

[58] Field of Search ..... 173/126, 127, DIG. 2; 145/29 B

[56] References Cited

U.S. PATENT DOCUMENTS

| | | | |
|---|---|---|---|
| 1,167,975 | 1/1916 | Burlingham | 173/127 |
| 2,787,984 | 4/1957 | Wahlsten | 173/127 |
| 3,570,609 | 5/1971 | Wise | 173/126 |
| 4,132,108 | 1/1979 | Hogenhout | 173/126 X |

FOREIGN PATENT DOCUMENTS

| | | |
|---|---|---|
| 922038 | 1/1955 | Fed. Rep. of Germany . |
| 9919 | of 1908 | United Kingdom . |

*Primary Examiner*—Wm. Carter Reynolds
*Attorney, Agent, or Firm*—Finnegan, Henderson, Farabow, Garrett & Dunner

[57] ABSTRACT

A ram block for driving piles and the like into the ground has a lead mass (15) which is enclosed in an inner cylinder (10) and in the space between this and an outer cylinder (11). The cylinders are interconnected at the lower end of the ram block where a cap (14) is arranged in the inner cylinder.

4 Claims, 3 Drawing Figures

RAM BLOCK

The present invention relates to a ram block for driving piles and the like into the ground.

Generally, conventional ram blocks are made of cast iron and are short and thick in shape. These cast iron ram blocks provide a short impact wave in the pile, but theoretically a long impact wave is aimed at, which means that it is desired to have a long duration of the period during which the pile is exposed to a force from the ram block, at the expense of a lower force.

The usual way of extending the impact wave in the pile is to use thick resilient and also damping shims between the ram block and the pile, and usually these shims are made of wood but also Nylon shims are used. With such a shim an equilization of the force is thus obtained so that the impact wave expressed as the force over the time will be more rectangular and not exponential as when the ram block is allowed to hit the pile directly. However, these conditions which are more favourable as such are associated with some energy loss in the blow, which may result in the shim getting charred.

The ideal condition would be to construct the ram block with the same length, the same cross section and the same weight as the pile to be driven, i.e. the blow should be effected by means of a pile which is substantially identical with the pile to be driven, but this leads to an impractical construction of the ram block.

Ram block constructions have been proposed previously, which provide a more favourable impact wave than the cast iron ram block and do not involve the drawbacks associated with the use of shims, but these constructions proposed previously wherein mechanical springs or gas springs are used are much more complicated and moreover are exposed to heavy wear when being used.

Furthermore, ram blocks have been constructed with a mass of lead or other damping material enclosed in a steel body in order to obtain thereby some attenuation of the oscillations.

The invention is based on the combination of a steel body and lead or similar material for the object of providing a ram block which is of a simple and sturdy construction and does not include springs or movable parts and which provides, at a relatively low sound level, a long impact wave such that one can let the ram block fall from a greater height without the force being so great that there is a risk of the pile being broken to pieces. Thereby the ram block will drive the pile more effectively.

For this purpose there is provided according to the invention a ram block for driving piles and the like into the ground, comprising a steel body having lead or similar material enclosed therein, with the characteristics appearing from claim 1.

Figure 1:
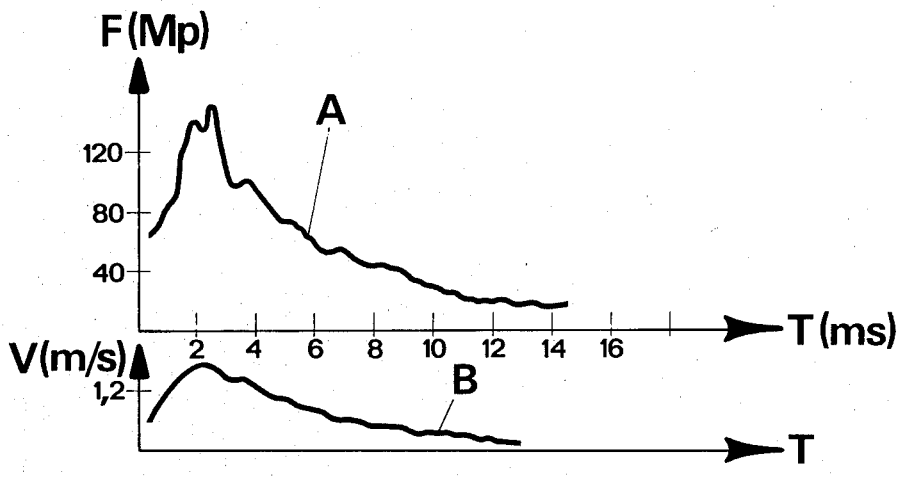
Figure 3:
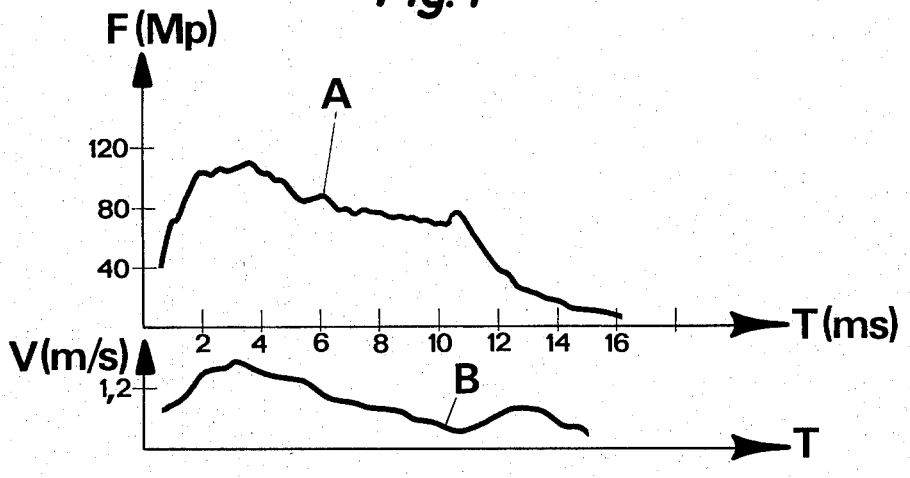
Figure 2:
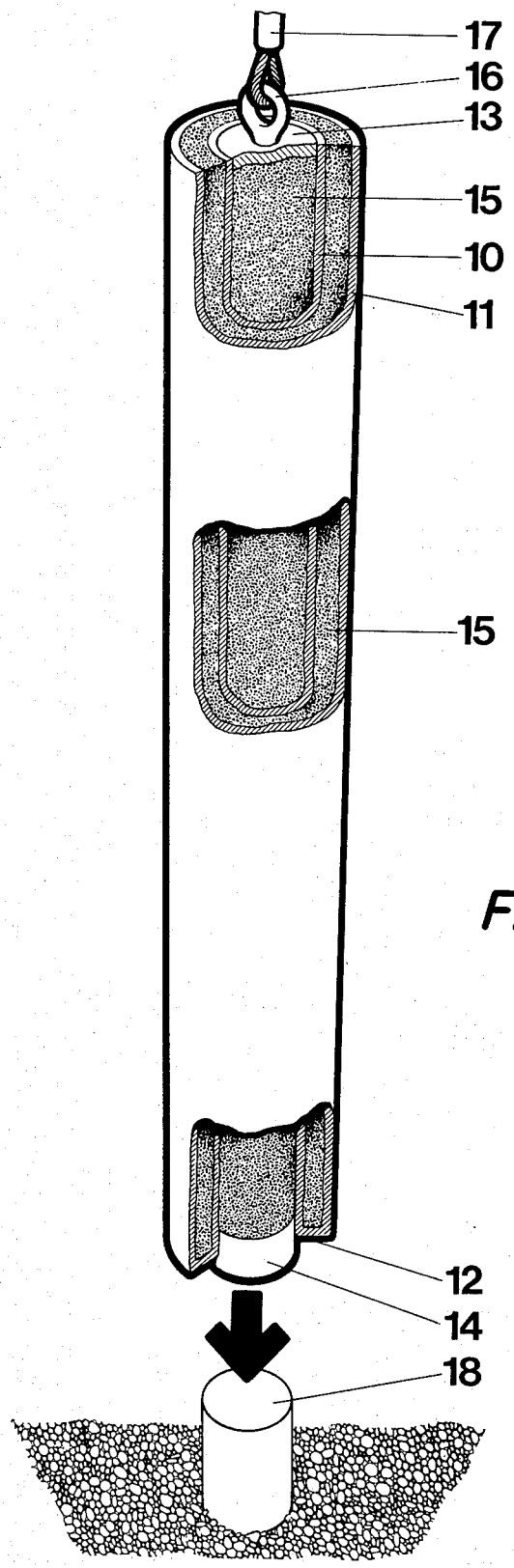

In order to illustrate the invention an embodiment thereof will be described in more detail below, reference being made to the accompanying drawings in which FIG. 1 is a diagram illustrating the impact wave and the penetration when using a ram block of a prior art construction having exponential impact wave, FIG. 2 is a perspective view, portions being broken away, of a ram block according to the invention, and FIG. 3 is a diagram corresponding to that of FIG. 1 relating to the novel ram block according to the invention.

In FIG. 1 the force obtained by means of a ram block of a prior art construction is plotted over the time as a graph A the force F in Mp being indicated on the vertical axis and the time T in ms being indicated on the horizontal axis. Along the same time axis a graph B is plotted, which relates to a ram block of a prior art construction and indicates the velocity V in m/s of the pile being driven, said velocity also being indicated along the vertical axis. As will be seen, the graph A has the appearance characteristic of an exponential impact wave. It is desired to achieve an equilization of the force over the time such that the graph will obtain a more rectangular form, and this is achieved by means of a ram block according to FIG. 2.

The novel ram block according to the invention, disclosed in FIG. 2, comprises an inner steel cylinder 10 and an outer steel cylinder 11, said cylinders being arranged coaxially and being interconnected at the lower ends thereof by means of an annular end wall 12. The inner steel cylinder 10 has an end wall 13 at the top thereof and in this cylinder a cap 14 is provided at the bottom thereof. The inner steel cylinder 10 and the annular space between this cylinder and the outer steel cylinder 11 are filled with lead 15. For the purpose of lifting the ram block thus constructed an eye bolt 16 is provided in the end wall 13; a wire rope 17 can be connected to said eye bolt.

When the ram block is lifted and is allowed to fall freely towards the upper end of a pile 18 to be driven into the ground the blow produced when the cap 14 hits the pile will be propagated through the lead mass 15 inside the inner steel cylinder 10 upwards towards the upper end thereof. By the intermediary of the end wall 13 the impact wave passes to the steel cylinder 10 and will be propagated downwards therein to the lower end wall 12 to be again propagated upwards therefrom in the part of the lead mass 15 contained between the steel cylinders 10 and 11. Thus, it could be said that the lead mass is "double-folded" such that it will take twice the time for the impact wave to travel through the ram block as in the case wherein the ram block comprises a lead mass enclosed in a single steel cylinder only. This means that functionally the ram block has a length twice as large as the true length. In reality, the functional length even will be larger than the double length of the ram block because the impact wave will be propagated upwards also through the outer steel cylinder before it will be reflected from the upper end of the ram block.

The three parts of the ram block which are involved in the propagation of the impact wave, viz. the lead mass 15 inside the inner steel cylinder 10, the steel mass of said cylinder, and the lead and steel mass in the space between the cylinders and in the outer steel cylinder 11, respectively, should be matched to each other as far as the acoustic impedance is concerned, in order to obtain an approximately constant force at the blow against the pile. This means that the properties of the materials and the dimensions of said three parts of the ram block are chosen in such a way that the force from the impact wave will be approximately constant without abrupt changes when passing between the parts.

FIG. 3 discloses in a diagram with graphs A and B of the same type as that in FIG. 1 the conditions when a ram block according to the invention constructed as shown in FIG. 2 and being acoustically matched as indicated above is being used. It will be seen that the graph A in FIG. 3 is much more rectangular than the corresponding graph in FIG. 1 and that there is obtained according to the graph B in FIG. 3 a more uniform driving of the pile. Thanks to the presence of the lead mass in the ram block the sound level when the pile is being driven also will be lower than when prior art ram blocks are being used.

Lead would be the material which is most suitable for use as the filling 15 in the cylinders 10 and 11. The sound velocity in lead is relatively low, which provides a desired longer duration of the impact. Instead of a short impact of great force a more extended impact of reduced force is obtained thereby and accordingly the risk of the pile being broken to pieces will be reduced. Instead of lead other materials having the ability to prolong the impact wave in this manner can be used.

I claim:

1. A ram block for driving piles and the like into the ground comprising an inner steel cylinder, an outer steel cylinder surrounding the inner steel cylinder coaxially, annular end wall means connecting the inner steel cylinder and the outer steel cylinder at the lower ends thereof, a cap connected to and covering the lower end of the inner steel cylinder, lead enclosed within the inner steel cylinder and lead enclosed in the annular space between the inner steel cylinder and the outer steel cylinder.

2. A ram block according to claim 1 wherein the material properties and dimensions of the inner steel cylinder, the lead enclosed within the inner steel cylinder, and the outer steel cylinder and lead enclosed between the cylinders provide a matching acoustic impedance so that a substantially constant force is propagated through the ram block by the impact wave resulting from impact of the ram block and a pile or like object.

3. A ram block for driving piles and the like objects into the ground comprising an inner steel cylinder, an outer steel cylinder surrounding the inner steel cylinder coaxially, annular end wall means connecting the inner steel cylinder and the outer steel cylinder at the lower ends thereof, a cap connected to and covering the lower end of the inner steel cylinder, a solid material enclosed within the inner steel cylinder and a solid material enclosed in the annular space between the inner steel cylinder and the outer steel cylinder, said solid materials having a relatively low sound velocity and the ability to prolong the impact wave resulting from the impact of said ram block on said piles.

4. A ram block according to claim 3 wherein the material properties and dimensions of the inner steel cylinder, the solid material enclosed within the inner steel cylinder, and the outer steel cylinder and solid material enclosed between the cylinders provide a matching acoustic impedance so that a substantially constant force is propagated through the ram block by the impact wave resulting from impact of the ram block and a pile or like object.

* * * * *